United States Patent [19]

Humphrey

[11] 4,148,164

[45] Apr. 10, 1979

[54] FASCIA BOARD SUPPORT

[76] Inventor: Gerald A. Humphrey, Rte. 3, P.O. Box 380, Lake Geneva, Wis. 53147

[21] Appl. No.: 842,560

[22] Filed: Oct. 17, 1977

[51] Int. Cl.[2] ..... A63H 23/04

[52] U.S. Cl. ..... 52/94; 52/105; 52/712; 403/4

[58] Field of Search ..... 52/94, 105, 90, 712, 52/715, 714; 403/4, 85, 232.1

[56] References Cited

U.S. PATENT DOCUMENTS

| | | | |
|---|---|---|---|
| 3,344,561 | 10/1967 | Anderson | 52/11 |
| 3,423,898 | 1/1969 | Tracy | 403/4 |
| 3,596,941 | 8/1969 | Tracy | 403/232.1 |
| 3,874,131 | 4/1975 | Webster | 52/11 |

FOREIGN PATENT DOCUMENTS

| | | | |
|---|---|---|---|
| 1100129 | 1/1968 | United Kingdom | 52/11 |

*Primary Examiner*—Price C. Faw, Jr.
*Assistant Examiner*—Henry Raduazo
*Attorney, Agent, or Firm*—Andrus, Sceales, Starke & Sawall

[57] ABSTRACT

A fascia board support comprises an angled piece of metal having a generally horizontal flange and a depending panel. A slit is provided in the panel which permits the horizontal flange to be bent and the central portion of the panel to overlap. In use, the support is placed on the exposed, squared end of a rafter. The flange is bent to provide a vertical part of the end of the rafter. The central portions of the panel become overlapped. The support is nailed to the rafter through holes in the overlapping portions. An index on the support permits the flange to be accurately bent for use with roofs of various pitches. The vertical part of the flange receives the fascia board, as by nailing.

10 Claims, 5 Drawing Figures

Fig. 3
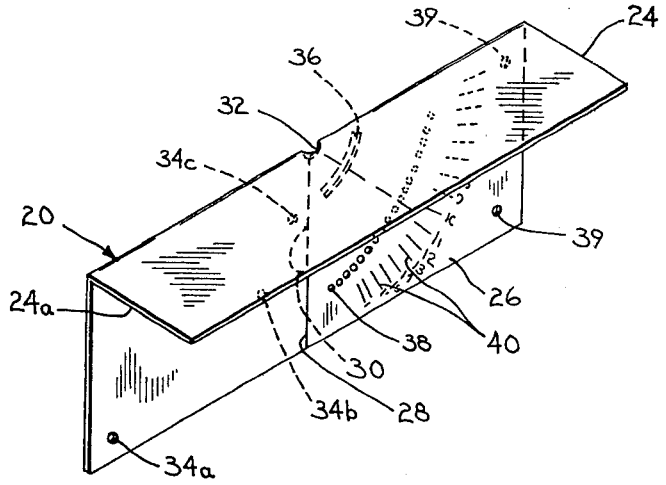
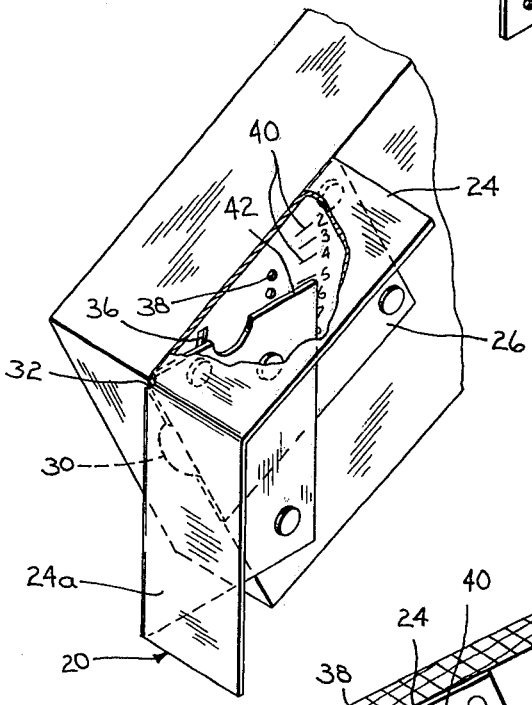
Fig. 4
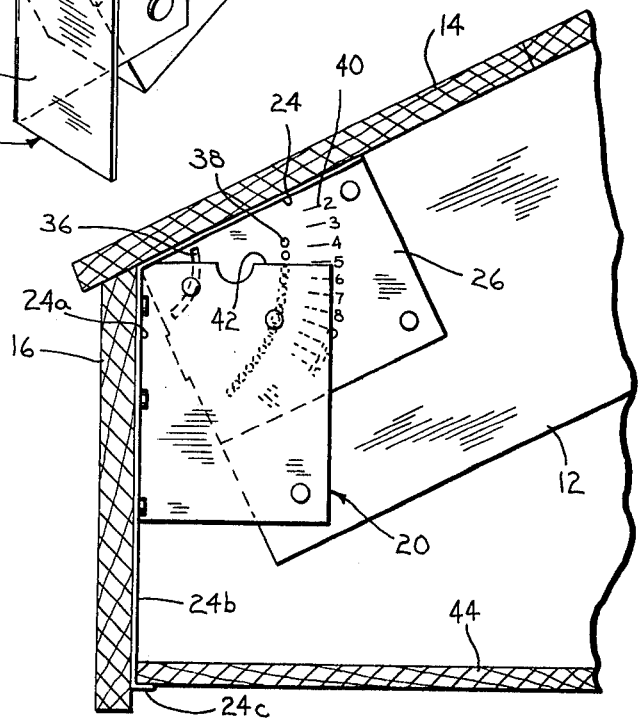
Fig. 5

FASCIA BOARD SUPPORT

BACKGROUND OF THE INVENTION

1. Field of the Invention

The present invention relates to the construction of buildings, particularly homes, and specifically to a device for fastening the fascia board to the ends of rafters.

2. Description of the Prior Art

In conventional housing construction, rafters slant downward from the peak of the roof to the upper edge of the wall. Boards are laid on the upper surface of the rafters to form the roof. The rafters and roof extend beyond the wall and eaves troughs at the edge of the roof receive the runoff from the roof. The eaves troughs are mounted on fascia boards fastened to the ends of the rafters and lying parallel to wall of the house.

It has heretofore been a practice to cut off the ends of the rafters so as to make the ends of the rafters parallel to the wall of the house for receiving the fascia board. This has required an angular cut through the rafters and the expenditure of a considerable amount of time, with resulting expense. Another practice, necessitated by the economics of modern construction is to simply nail the fascia board to the upper edge of the squared ends of the rafters or to the roof boards. Because of the poor connection of the fascia board, accummulations of ice, snow, wet leaves, and the like often cause the fascia board to separate from the rafters.

SUMMARY OF THE PRESENT INVENTION

The present invention provides a means for rapidly, firmly, and economically fastening the fascia board to the rafters, thereby to improve the quality of home construction while reducing its cost.

The fascia board support of the present invention comprises an angled piece of metal having, in use, a generally horizontal flange and a depending panel. The width of the flange and, particularly, the depth of the panel may be sized in accordance with the size of the rafter to which the support is affixed.

The depending panel is slit in the central portions thereof to allow the horizontal flange to be bent so that the central portions of the panel overlap. The central portions of the panel contain holes for nails or other fasteners.

The horizontal flange is bent downward by an amount sufficient to provide a part which is vertical when the support is affixed to a sloping rafter. A series of index marks may be provided on one of the central portions of the flange which co-act with the edge of the other overlapping portion to allow the support to be accurately bent for use on roofs of a variety of standard pitches.

The support is placed along side the end of the rafter with the panel against the side of the rafter, the downwardly bent part of the flange off the end of the rafter and the remainder of the flange abutting the lower surface of the roof. Nails are driven through the overlapping central portions of the flange to affix the support to the rafter. The fascia board is fastened to the downwardly bent part of the flange.

In a modification of the support, the downwardly bent part of the flange may be extended to provide support for the outer edge of the soffit board.

BRIEF DESCRIPTION OF THE DRAWING

FIG. 3 is a perspective view of the fascia board support of the present invention.

FIG. 4 is a perspective view of the fascia board support of the present invention installed on the end of a rafter.

FIG. 5 is a side view of the modification of the fascia board support of the present invention.

DETAILED DESCRIPTION OF THE PREFERRED EMBODIMENT

Figure 1:
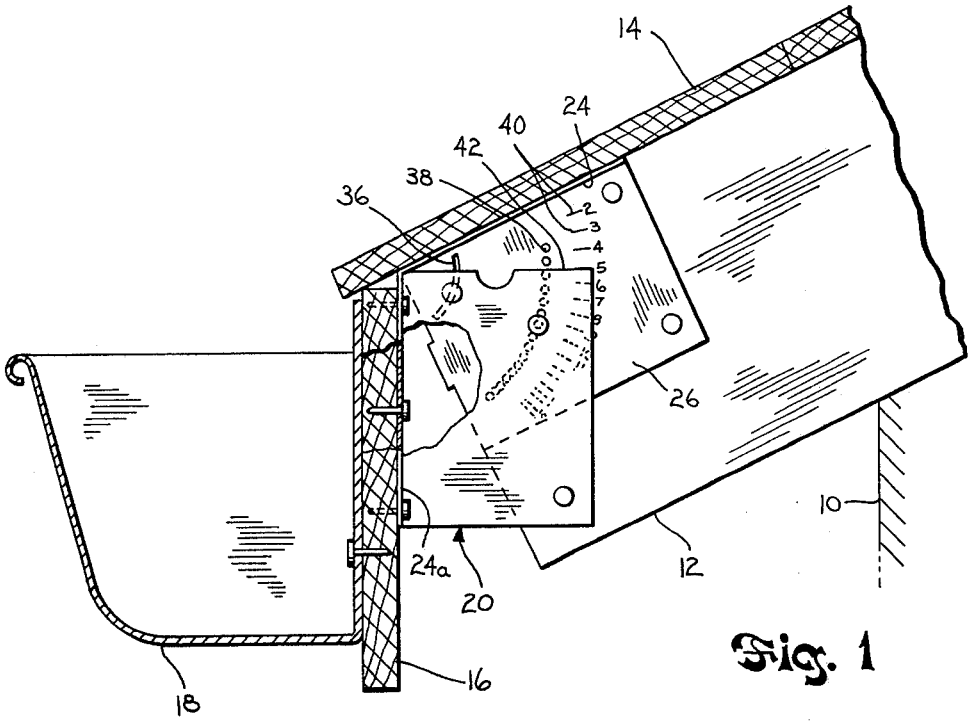
FIG. 1 is a side view of the fascia board support of the present invention.

FIG. 1 shows a building having wall 10 supporting rafters 12 on which lie roof boards 14 covered by shingles, not shown. The ends of rafters 12 are cut square to the length of the rafters, as at the mill. With conventional construction techniques, to position fascia board 16 containing eaves trough 18 parallel to wall 10 either an angular cut must be made through the end of each of rafters 12 or the board nailed to the upper corner of the rafters. The angular cut requires the expenditure of considerable amount of labor while nailing to the upper corner of the rafter results in a poor connection. Both these problems are eliminated with fascia board support 20 of the present invention.

Figure 2:
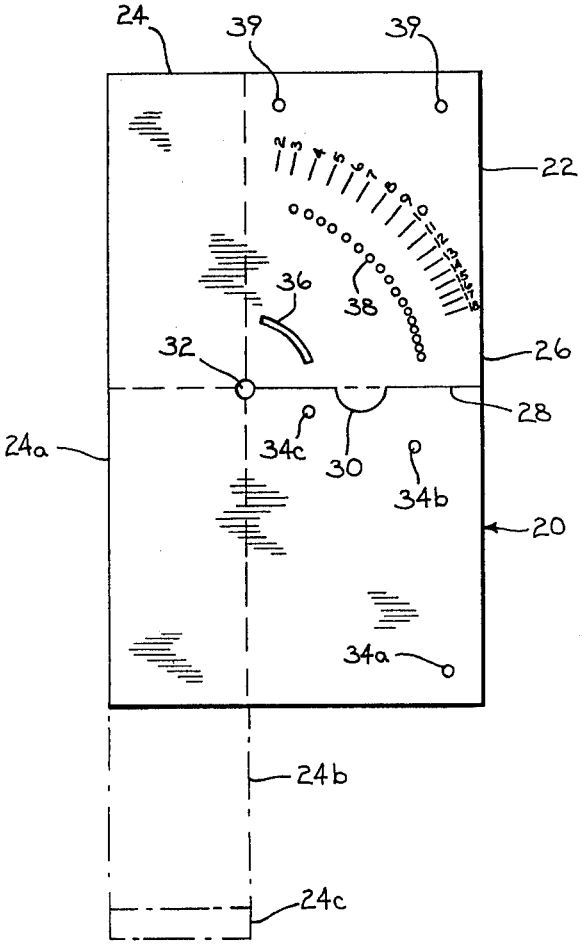
FIG. 2 is a plan view of the fascia board support in the unbent condition, a modification to the support being shown in dot-dash lines.

FIGS. 2 and 3 show the fascia board support 20 of the present invention in detail. Support 20 comprises a piece of bendable metal 22 having a generally horizontal flange 24 and a vertical panel 26 when support 20 is oriented as shown in FIG. 3. The width of horizontal flange 24 and the depth of flange 26 may be commensurate with the size of the rafters with which the support is to be used, as for example, 2×4", 2×6", etc. Typically the width of horizontal flange 24 may correspond to the width of the rafter and the depth of depending flange 26 will correspond to some fraction of the height of the rafter.

A vertical slit 28 is provided in the central portions of depending panel 26. Slit 28 extends from the edge of panel 26 to the crease which forms horizontal flange 24. Slit 28 may contain an arcuate portion 30 in the center and terminate at hole 32.

Slit 28 permits horizontal flange 28 to be bent along a projection of the slit across the flange and permits the central portions of depending flange 26 to overlap, as shown in FIG. 4. Flange 26 contains a plurality of holes for nails or other fasteners. These include holes **34*a*, 34*b*, 34*c*, slot 36, a series of holes 38 arranged in a generally arcuate configuration, and holes 39**.

In use, the central portions of depending flange 26 on either side of slot 28 are shifted out of alignment so that the left hand portion, as shown in FIG. 3 overlaps the right hand portion. Flange 24 is then bent downwardly along the projection of slit 28 causing the central portions of flange 26 overlap. The amount of bend provided to flange 24 is such as to cause the part **24*a* to assume a vertical orientation, as shown in FIG. 4. This may be done by placing the support on the end of the installed rafter and bending flange 24 until part 24*a*** is vertical, as measured by a level or other carpenter's tool.

In the alternative, an index means comprising a series of graduations 40 may be provided on one of the central portions of flange 26 to coact with the edge 42 of the other central portion. The graduations indicate the amount by which flange 24 must be bent for roofs of standard pitch for example, a decrease of five inches in vertical dimension for each foot of horizontal dimension of the roof, eight inch drop per horizontal foot, etc. Flange 20 is bent until the edge 42 of one of the central portions is in register with the appropriate graduation of the other central portion.

Support 20 is then placed on the end of the rafter with one corner of the rafter at the bend in horizontal flange 24. The tab formed by the arc 30 of slit 28 may be bent normal to the plane of the central portion of panel 26 to assist in positioning the support on the end of the rafter as shown in FIGS. 1, 4, and 5. Nails are then driven through holes 34*c* and slot 36 in the central portions into the rafter. A nail is also driven through hole 34*b* into the one of holes 38 which is in registration with hole 34*b*. Other nails are driven through the non-overlapped portions of panel 26 through holes 34*a* and 39.

With support 20 so affixed to the end of rafter 12, the part 24*a* of flange 24 is positioned in a vertical plane on the end of the rafter. As shown in FIG. 1, fascia board 16 is nailed to part 24*a* and eaves trough 18 nailed to fascia board 16.

In the modification of the invention shown in the FIG. 5, the part 24*a* of flange 24 is extended to provide extension 24*b* containing lip 24*c*. This extension lies along the interior surface of fascia board 16, as shown in FIG. 5. Soffit board 44 has its outer edge supported by lip 24*c* and its inner edge supported by a corresponding lip or support device on the wall 10 of the house, not shown. The support means of the present invention thus further serves to facilitate the installation of the soffit board.

Various modes of carrying out the invention are contemplated as being within the scope of the following claims particularly pointing out and distinctly claiming the subject matter which is regarded as the invention.

I claim:

1. A support for affixing a fascia board to the end of a rafter supporting a roof comprising:

a rectangular piece of sheet-like material bent at a single crease to form an L-shaped section normal to said crease, said support having a flange with a depending panel lying normal thereto, said flange being suitable for positioning adjacent the under side of the roof alongside the rafter and said panel being suitable for positioning on the side of the rafter and joinable thereto, said panel having a slit in the central portion thereof extending across said panel and terminating at said crease, said slit permitting said flange to be bent at the point of termination of said slit to provide a downwardly extending vertical part suitable for receiving the fascia board, the central portions of said panel being overlapped by the bending of said flange.

2. The support according to claim 1 wherein the central portions of said panel include index means operable when said central portions overlap to indicate the amount of bend in the flange.

3. The support means according to claim 2 wherein said index means includes a series of graduations on one of said overlapping central portions co-acting with an edge of the other overlapping central portion.

4. The support according to claim 1 wherein said central portions has means for affixing said support to said rafter.

5. The support according to claim 4 wherein said central portions have a plurality of holes for receiving fasteners which affix the support to the rafter.

6. The support according to claim 5 wherein certain of the holes in each of said central portions are positioned for registration when said central portions overlap.

7. The support according to claim 6 wherein said holes are positioned for registration at a bend of a predetermined amount in the flange.

8. The support according to claim 7 wherein said holes are positioned for registration for a plurality of bends of said flange.

9. The support according to claim 1 wherein said slit has an arcuate portion forming a tab on one of the central portions which may be bent normal to the plane of the central portion to assist in positioning the support on the end of the rafter.

10. The support according to claim 1 wherein said vertical part of said flange has an extension extendible below the rafter when said support means is affixed thereto, said extension having a lip for supporting one edge of a soffit board.

* * * * *